US009523202B2

(12) United States Patent
Anderson et al.

(10) Patent No.: US 9,523,202 B2
(45) Date of Patent: Dec. 20, 2016

(54) ROOFING PANEL WITH INTERLOCKING CLIPPING SYSTEM

(71) Applicant: Building Materials Investment Corporation, Dallas, TX (US)

(72) Inventors: Eric R. Anderson, Montclair, NJ (US); Sudhir Railkar, Wayne, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 0 days.

(21) Appl. No.: 14/947,624

(22) Filed: Nov. 20, 2015

(65) Prior Publication Data

US 2016/0145872 A1 May 26, 2016

Related U.S. Application Data

(60) Provisional application No. 62/083,615, filed on Nov. 24, 2014.

(51) Int. Cl.
*E04D 1/18* (2006.01)
*E04D 3/362* (2006.01)
*E04D 3/30* (2006.01)

(52) U.S. Cl.
CPC ..... *E04D 3/362* (2013.01); *E04D 3/30* (2013.01)

(58) Field of Classification Search
CPC ..... E04F 13/0864; E04D 1/18; E04D 1/265
USPC ..... 52/520, 529, 531
See application file for complete search history.

(56) References Cited

U.S. PATENT DOCUMENTS

| | | | | |
|---|---|---|---|---|
| 550,325 | A | 11/1895 | Kinnear | |
| 1,539,632 | A * | 5/1925 | Belding | E04D 1/18 52/520 |
| 1,743,206 | A | 1/1930 | Fulenwider et al. | |
| 2,042,890 | A | 6/1936 | Fulenwider et al. | |
| 2,766,861 | A * | 10/1956 | Abramson | E04F 13/0864 52/530 |
| 3,325,952 | A * | 6/1967 | Trachtenberg | E04F 13/0864 52/276 |
| 4,079,561 | A | 3/1978 | Vallee | |
| 4,522,007 | A * | 6/1985 | Oehlert | E04C 2/40 52/506.1 |
| 4,932,184 | A | 6/1990 | Waller | |
| 5,349,801 | A | 9/1994 | Verbofsky | |
| 5,469,680 | A | 11/1995 | Hunt | |
| 5,613,337 | A | 3/1997 | Plath | |
| 6,170,215 | B1 * | 1/2001 | Nasi | E04F 13/0864 52/521 |

(Continued)

*Primary Examiner* — Rodney Mintz
*Assistant Examiner* — Daniel Kenny
(74) *Attorney, Agent, or Firm* — Womble Carlyle Sandridge & Rice LLP

(57) ABSTRACT

Metal roofing panels have a forward edge portion with a downwardly extending skirt and return flange and a rear edge or headlap portion with an upwardly open channel and a locking tab extending over a portion of the upwardly open channel. A method of installing the roofing panels includes nailing a lower course of panels in end-to-end overlapping relationship to a roof deck. The forward edge portions of panels in the next higher course of panels are then pressed downwardly into the upwardly open channels of the lower course panels. The return flanges of the upper course panels snap beneath the locking tabs of the upwardly open channels thus locking the panels together and forming a watertight connection between courses of panels.

23 Claims, 3 Drawing Sheets

(56) References Cited

U.S. PATENT DOCUMENTS

| | | | | |
|---|---|---|---|---|
| 6,363,676 | B1 * | 4/2002 | Martion, III | E04F 13/0864<br>52/519 |
| 7,246,474 | B2 | 7/2007 | Dombek | |
| 2010/0186334 | A1 | 7/2010 | Seem | |

* cited by examiner

ROOFING PANEL WITH INTERLOCKING CLIPPING SYSTEM

REFERENCE TO RELATED APPLICATION

Priority is hereby claimed to the filing date of U.S. provisional patent application 62/083,615 entitled Roofing Panel with Interlocking Clipping System filed on Nov. 24, 2014, the entire contents of which is hereby incorporated by reference.

TECHNICAL FIELD

This disclosure relates generally to roofing and more particularly to metal roofing configured to mimic the appearance of traditional roofing products such as slate shingles and cedar shake shingles.

BACKGROUND

Metal roofing has long been used to cover roofs of homes and other buildings. Typical metal roofing includes, for instance, long metal panels that extend from a roof ridge all the way to the eves of a roof. These roofing panels may be connected together along their edges with standing seams or they may be attached to a roof deck with overlapping ridges along their edges. Either creates a barrier to water penetration along the connected edges of panels. In recent years, decorative metal roofing panels that, when assembled, resemble other traditional types of roofing have become popular. For example, decorative metal roofing panels that resemble cedar shakes, barrel shingles, or slate shingles are among the available choices for consumers. Although popular, decorative roofing panels have suffered from a variety of problems for installers and homeowners including difficult installation, susceptibility to wind and water penetration once installed, objectionable brakes in geometry, and ship lapped ends susceptible to water leakage. There is a need for a decorative roofing panel that addresses these and other problems and shortcomings of the prior art. It is to the satisfaction of this need and to provide other improvements and advantages that the roofing panels disclosed herein are primarily directed.

SUMMARY

Briefly described, a decorative metal roofing panel is pressed or otherwise formed with an aesthetic geometry and an applied coating that mimics the look of a traditional architectural roofing product such as slate for example. A snap locking mechanism functions to lock the forward edge portion of a panel to the rear edge or headlap portion of a like panel in an installed lower course of panels. More particularly, a downwardly extending skirt with a return flange is formed along the forward edge of each panel and an upwardly open channel is formed along the rear or headlap portion of each panel. The upwardly open channel incorporates a locking tab that extends partially over the opening of the channel and a nailing flange extends rearwardly from the channel.

During installation, roofing panels according to the present invention are attached to previously installed panels in a lower course by pressing the forward edge skirt and return flange of each panel downwardly into the upwardly open channel of an installed panel or panels in the lower course. The locking tab of the channel engages the return flange causing it to bend or flex as the skirt is urged into the channel. As the return flange passes the locking tab, the return flange springs back underneath the locking tab and this locks the skirt of the panel into the channel of the previously installed panel. The panel can then be attached to the roof deck with nails or other fasteners driven through the nailing flange behind its own upwardly open headlap channel. The configurations of the skirt and the channel form walls that act as dams against penetration of wind and water and installation is simplified significantly and made more certain. Further, the "click" of the skirt locking into an upwardly open channel ensures an installer that a panel is correctly installed thereby simplifying installation.

These and other features, aspects, and advantages of the disclosed roofing panel will be better appreciated upon review of the detailed description set forth below taken in conjunction with the accompanying drawing figures, which are briefly described as follows.

DETAILED DESCRIPTION

Figure 1:
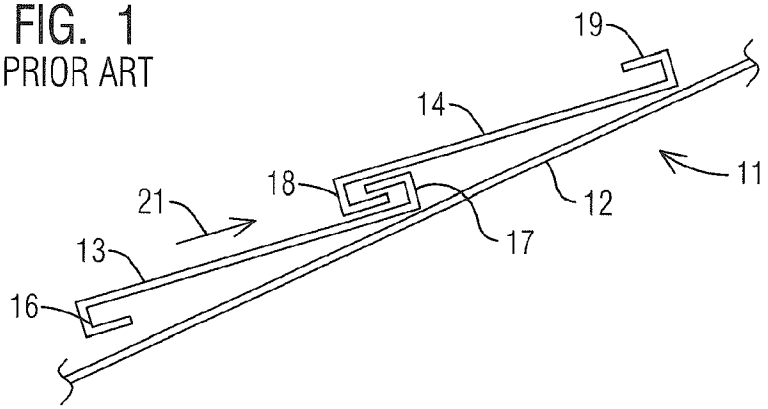
FIG. 1 PRIOR ART
FIG. 1 is a side view of a prior art decorative metal roofing panel showing how the panels commonly are attached together bottom to top.

Reference will now be made to the attached drawing figures, wherein like reference numerals indicate like parts throughout the several views. FIG. 1 shows a pair of typical prior art metal roofing panels 11. Lower panel 13 is attached to a roof deck 12 and is part of a lower course of end-to-end roofing panels. Upper panel 14 is attached to the roof and its forward edge portion 18 overlies a rear headlap portion 17 of lower panel 13. The forward edges 16, 18 of the lower and upper panel respectively are formed with downwardly extending J-bends and the headlap portions 17, 19 are formed with upwardly extending J-bends. As shown, roofing panels 14 of upper courses are interlocked with roofing panels 13 of lower courses by sliding each upper course panel up the roof in direction 21 until their J-bends engage and interlock with the J-bends of panels in a lower course. As mentioned above, this presents a number of problems including but not limited to less than reliable resistance to wind and water penetration and less than precise installation. The less precise installation results at least in part from the fact that upper panels must be slid upwardly against the pull of gravity and held firmly in place by an installer as the installer simultaneously affixes the panels to a roof deck with fasteners. It is difficult to hold a panel up firmly and accurately in place while at the same time attaching it to the roof deck. As a result, panels can become skewed, which be unsightly and prone to cause leaks.

Figure 2:
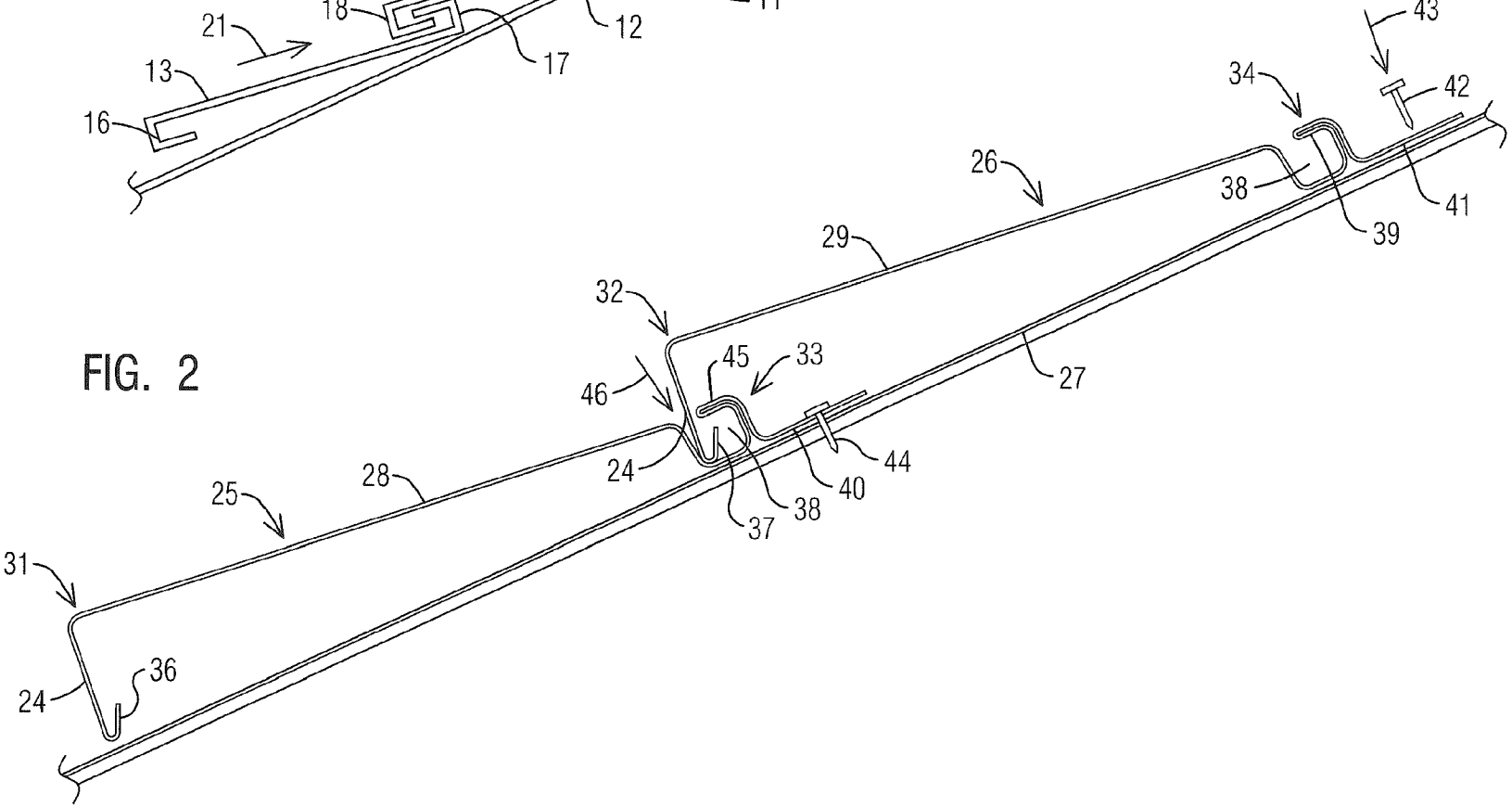
FIG. 2 is a side view of roofing panels according to the present disclosure showing how the panels are attached together bottom to top.

FIG. 2 shows a pair of metal roofing panels including a lower panel 25 and a like upper panel 26 interconnected according to one embodiment of the present invention. The lower and upper panels 25, 26 have upper surfaces 28, 29 that may be printed and/or pressed and/or embossed to mimic the look of a traditional shingle product such as a cedar shake, barrel shingle, or slate shingle. A forward edge portion 31, 32 of each panel has a downwardly extending skirt 24 that terminates along its bottom edge in an inwardly and upwardly extending return flange 36, 37. The rear or headlap portions 33, 34 are roll formed, stamped, or otherwise configured to define an elongated upwardly open channel 38 with an inwardly extending locking tab 45, 39 that extends partially across the opening of the channel. A nailing flange 40, 41 extends rearwardly from the channel 38 of each panel and is sized such that roofing nails 42, 44 or other fasteners can be driven through the nailing flange 40, 41 in direction 43 and into the roof deck below to attach the head lap portion of a panel to the roof deck.

When installing the roofing panels of this invention, an installer attaches a lower course of roofing panels 25 in ship lapped end-to-end relationship along the roof deck. Roofing panels 26 of the next higher course are then installed above the lower course of panels. More specifically, each panel 26 of the next higher course is positioned with its return flange 37 aligned with the openings of channels 38 of the panels 25 in the lower course. Each panel of the upper course is then pressed downwardly by the installer toward the roof deck and generally with the direction of gravity as indicated by arrow 46. This action causes the return flange 37 and the locking tab 45 to deflect elastically to allow the return flange 37 to move into the open channel under the influence of the installer's downward force. The mere act of pressing downwardly rather than sliding up the roof as in the prior art greatly simplifies installation.

When the return flange 37 moves beyond the locking tab 45, the flange and locking tab snap back elastically until the return flange is mechanically captured beneath the locking tab 45 as shown. This results in a confirming "click" indicating to an installer that the panels are properly interlocked. The forward edge portion 32 of the roofing panel 26 in the next higher course thus becomes securely and mechanically interlocked within the upwardly open channel 38 of a panel or panels 25 in the next lower course. In addition, the "clicking" sensation provides the installer with a positive indication that the panel has been interlocked completely and correctly. The panel can then be fastened to the roof deck 27 with roofing nails 42 driven through its nailing flange and into the roof deck. In this regard, there is no need for an installer to hold the panel up and in its proper position manually while it is being nailed to the roof deck as with prior art panels. This is because the forward walls of the channel 38 of panels 25 in the lower course prevent the just installed panel 26 from slipping down the roof deck before or during being nailed in place. Installation continues in by attaching panels end-to-end to complete a course and installing successively higher courses until the roof deck is completely shingled. The end result is a metal roofing panel installation within which the panels are precisely aligned in each course and fastened securely to the roof deck.

Figure 3:
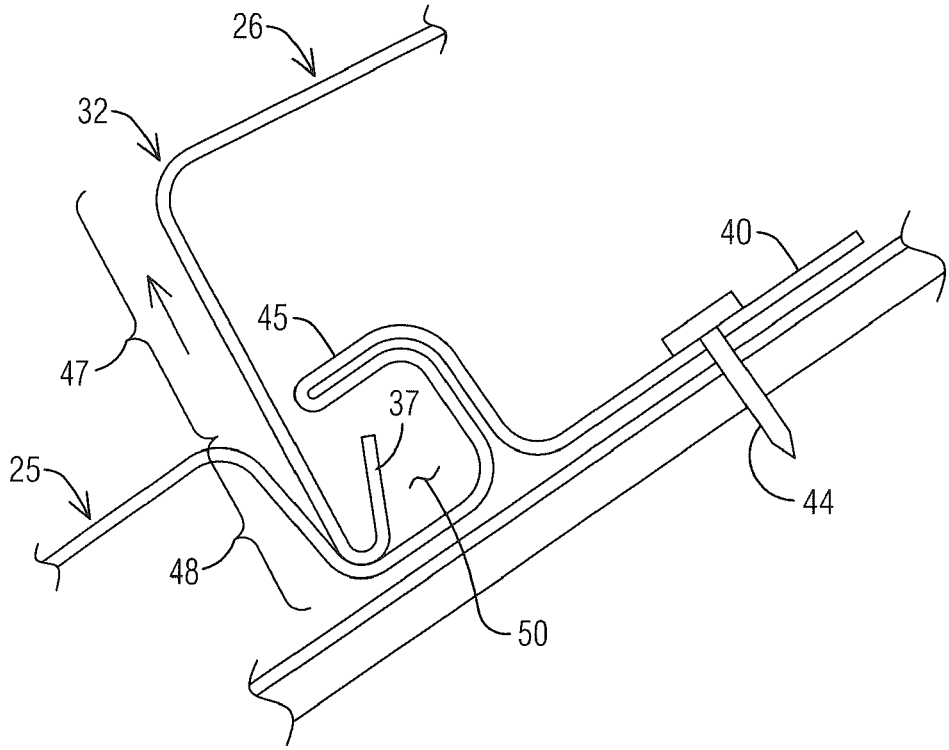
FIG. 3 is an enlarged side view showing the forward skirt of an upper panel locked within the upwardly open channel in the headlap portion of a previously installed lower panel.

FIG. 3 is an enlarged view showing the interlocked portions two roofing panels 25 and 26 according to one embodiment of the present invention. In this embodiment, the upwardly open channel 50, locking tab 45, and nailing flange 40 are formed along the headlap portion of the roofing panel 25 of a lower course by an appropriate bending process such as, for example, roll forming. However, these features also may be formed by any other process that produces substantially the same configuration and result. The forward edge portion 32 of the panel 26 in the upper course has an aesthetic geometry zone 47 that is exposed above the channel 50 and a prismatic geometry zone 48 that extends downwardly into and interlocks within the channel 50. The prismatic geometry zone 48 includes the lower part of the skirt along the forward edge of the panel and the return flange 37. Roofing panels are attached to the roof deck with nails 44 driven through the nailing flange 40 behind the channel 50. In this way, the nails are shielded by the back wall of the channel 50, the locking tab 45, and the overlying panel 26 from water and moisture. The nails are therefore far less likely to rust due to moisture and water is far less likely to penetrate the roof deck through the nail holes formed therein.

Figure 4:
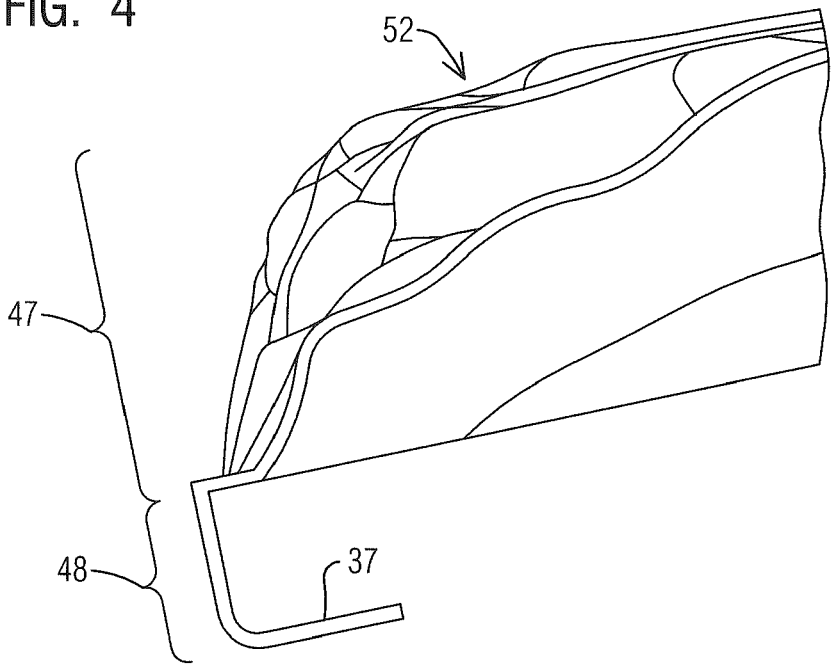
FIG. 4 is a side view of the forward edge of a panel of this disclosure showing a pressed aesthetic geometry in the exposed area of the panel and a prismatic geometry of the skirt and return flange.

FIG. 4 illustrates the forward portion of a roofing panel according to one embodiment. Here, the visible aesthetic geometry zone 47 has been pressed, roll formed, embossed, or otherwise molded so that its surface 52 is textured to mimic the appearance of a traditional roofing product, in this case a natural slate shingle. Preferably, the molded texture pattern is aligned with hues, tones, and patterns previously printed or coated onto the surface 52 of the roofing panel, or applied after formation, in such a way that the metal roofing panel more closely resembles and mimics an actual natural appearance of a slate shingle. Other patterns can be coated onto and molded into the panel to mimic other traditional roofing products such as shake shingles, tile shingles, barrel shingles and even asphalt shingles if desired. In FIG. 4, the return flange 37 is seen extending rearwardly, but it will be understood that the upwardly angled orientation of the return flange 37 shown in FIG. 3 is formed during manufacturing and is part of the finished product.

Figure 5:
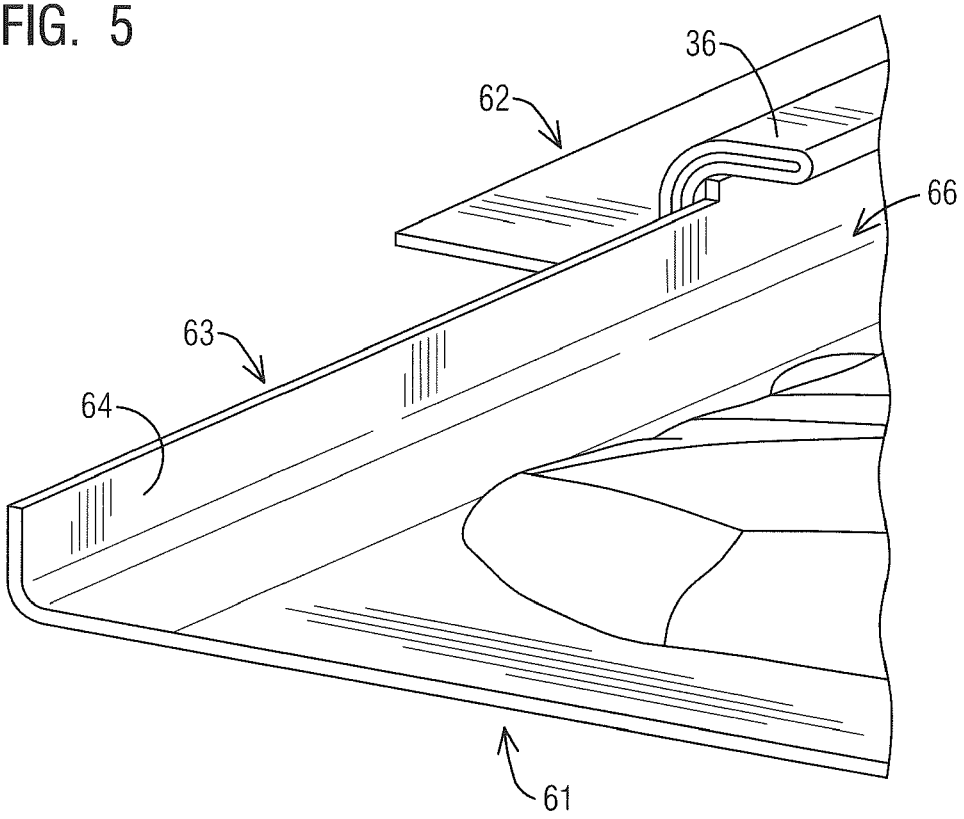
FIG. 5 is a perspective view showing a ship lap portion at one end of a metal roofing panel to accommodate end-to-end overlapping of panels according to one aspect of the present disclosure.

FIG. 5 shows one end of a roofing panel 61 that is configured to be overlapped by an opposite end of a like adjacent roofing panel in a course of panels. In this embodiment, the channel 66 and its return flange 36 have been cut away in the region to be overlapped. This allows an installer to lay an opposite end of a like panel over the end shown in FIG. 5 with the channel and locking tab of the overlying shingle abutting the truncated end of channel 66 and locking tab 36. This forms a continuous upwardly open channel and locking tab across the region of overlap. An upwardly bent wall 64 is left intact along the top of the overlapped portion to form a barrier against windblown rain and other moisture penetration. With this configuration, an integrated barrier is formed on the roof along ship lapped portions of adjacent roofing panels. Further, a continuous collinear channel is created along the headlap portion of an entire course of panels when they are installed.

In general, it is desired to create a roofing panel (which is metal in the preferred embodiment but that can be made of other materials such as plastics) that offers improvements in the installation, wind resistance, and water penetration resistance. Prior art roofing panels have several inherent problems and issues that the panel of the present invention addresses. For example, the unique clip interlocking geometry in the headlap area that receives the return flange and part of the skirt of a like panel offers improved installation as well as improved wind and water penetration resistance. Second, the invention includes end lap geometry that improves the water resistance in overlapped regions of end-to-end panels while facilitating a faster installation process.

As discussed briefly above, the snap locking feature secures the forward edge of each roofing panel into the upwardly open channel in the headlap portion of a roofing panel or panels in a next lower course of panels. The construction of the snap locking mechanism is such that the direction of interconnection is downwardly perpendicular to the roof deck instead of parallel to and up the roof deck as in prior art panels. In addition, the snap locking mechanism includes a vertical step to ensure that an installed panel (i.e. a panel with its forward edge pressed into the channel of a lower panel) does not slide down the roof under the influence of gravity and become cocked or misaligned between the time it is snapped to a lower panel and the time it is nailed to the roof deck along its nailing flange. As mentioned, this is a persistent problem with prior art designs such as that shown in FIG. 1.

Additionally, since the interlocking connection between an upper and a lower panel is hidden or blocked from the wind by the forward edge of the upper panel, wind uplift resistance of interconnected panels on a roof deck is significantly improved. Further, the design of the locking mechanism hides the prismatic vertical face necessary for installation as illustrated in FIG. 3, which creates a better aesthetic unity in the design. This is because portions of the panels that carry or are formed with visible aesthetic and/or organic designs are not disrupted by horizontal lines of the flat prismatic surface of the skirt of each panel. These prismatic portions are hidden within the channels of panels in the next lower course.

The headlap portion in the region where two side-by-side panels are overlapped during installation is notched or cut as shown in FIG. 5 for easier installation. However, the cut is made to leave an upwardly curved wall to prevent water from penetrating at the tops of an overlap region of two end-to-end panels. Additionally, the headlap section is formed in such a way that the nail zone or nailing flange is above (up the roof deck from) the interlocking features. This prevents water from finding its way to the nailing flange and penetrating the nailing flange and roof deck through nail holes.

The invention has been described herein in terms of preferred embodiments and methodologies considered by the inventors to represent the best modes of carrying out the invention. It will be clear to the skilled artisan, however, that a wide range of additions, deletions, and modifications, both subtle and gross, might well be made to the exemplary embodiments presented herein without departing from the spirit and scope of the invention that they exemplify. For example, while the channel of the illustrated embodiments is upwardly open, it is contemplated that these channels may be formed to be open to the forward or rear side of the panel. With such a configuration, panels would be interlocked by sliding one panel up or down relative to a panel in a lower course until its skirt engaged and interlocked into the channel of the lower panel. In this and other ways, the invention is not limited in scope by the specific examples presented, but only by the claims hereof.

What is claimed is:

1. A roofing panel comprising:

an upper surface to be exposed to ambience when the roofing panel is installed on a roof;

a forward edge portion;

a rear headlap portion opposite the forward edge portion;

a first end portion extending between the forward edge portion and the headlap portion at a first end of the panel and a second end portion extending between the forward edge portion and the headlap portion at a second end of the panel opposite the first end;

the forward edge portion comprising a downwardly extending skirt having a return flange extending from a bottom edge of the skirt;

the rear headlap portion comprising an open channel extending at least partially along its length and having a forward wall, a bottom wall, and a back wall, with the forward wall being defined by a downward step between the upper surface and the bottom wall, the open channel being sized to receive the return flange and a portion of the skirt of the forward edge of a like panel to interlock two panels together front-to-back; and a nailing flange extending rearwardly of the open channel for receiving fasteners attaching the roof panel to a roof deck.

2. A roofing panel as claimed in claim 1 further comprising a locking tab extending partially across the open channel and being configured to capture the return flange of the like panel.

3. A roofing panel as claimed in claim 2 wherein the return flange extends rearwardly from the bottom edge of the skirt.

4. A roofing panel as claimed in claim 3 wherein the locking tab extends forwardly from the back wall across a portion of the open channel.

5. A roofing panel as claimed in claim 1 wherein the open channel is integrally formed with the roofing panel.

6. A roofing panel as claimed in claim 5 wherein the roofing panel is roll formed from a sheet of the roofing panel material having a substantially constant thickness.

7. A roofing panel as claimed in claim 1 wherein a portion of the open channel is cut away at the first end of the panel so that the first end may be overlapped by the second end of a like panel to join the panels in end-to-end relationship.

8. A roofing panel as claimed in claim 7 further comprising an upturned wall extending along the cut away portion forming a dam to inhibit seepage of water at the tops of two end-to-end overlapping panels.

9. A roofing panel as claimed in claim 1 wherein the open channel is upwardly open.

10. A roofing panel installation comprising a plurality of the roofing panels of claim 9 installed in courses with the skirts and return flanges of panels in upper courses being interlocked within the upwardly open channels of panels in the next lower course of panels.

11. A roofing panel comprising an upper surface, a forward edge portion, a rear edge portion, a first end portion, and a second end portion, the forward edge portion being formed to define a downwardly projecting skirt having a return flange extending at an angle from a lower edge of the skirt, the rear edge portion being formed to define an elongated upwardly open channel having a forward wall, a bottom wall, and a back wall, with the forward wall being defined by a downward step between the upper surface and the bottom wall, the open channel being sized to receive the return flange and at least a portion of the skirt of a like panel for attaching the forward edge portion of the like panel to the rear edge portion of the panel.

12. A roofing panel as claimed in claim 11 wherein the return flange extends rearwardly from the skirt.

13. A roofing panel as claimed in claim 11 wherein the return flange extends rearwardly and upwardly from the skirt.

14. A roofing panel as claimed in claim 11 further comprising a locking tab projecting across a portion of the upwardly open channel.

15. A roofing panel as claimed in claim 14 where the locking tab is configured to capture the return flange when the return flange and at least a portion of the skirt are inserted into the upwardly open channel of a like roofing panel.

16. A roofing panel as claimed in claim 11 wherein a portion of the upwardly open channel is cut away at the first end of the panel to accommodate end-to-end overlapping of two like panels on a roof.

17. A roofing panel as claimed in claim 16 further comprising an upturned wall extending along the rear of the cut away portion forming a dam against water migration.

18. A roofing panel as claimed in claim 11 wherein the panel is formed with a textured upwardly facing surface.

19. A roofing panel as claimed in claim 18 wherein the upwardly facing surface is textured to mimic a traditional shingle.

20. A roofing panel as claimed in claim 19 wherein the traditional shingle is a slate shingle.

21. A roofing panel as claimed in claim 19 wherein the traditional shingle is a shake shingle.

22. A roofing panel as claimed in claim 19 wherein the traditional shingle is an asphalt shingle.

23. A roofing panel as claimed in claim 19 wherein the traditional shingle is a barrel shingle.

* * * * *